US006418767B2

(12) United States Patent
Shinbutsu et al.

(10) Patent No.: US 6,418,767 B2
(45) Date of Patent: Jul. 16, 2002

(54) ROUND DIE TYPE FORM ROLLING APPARATUS

(75) Inventors: Toshinaka Shinbutsu; Minoru Yoshizawa; Shuichi Amano, all of Ohtsuki; Katsuyuki Nakata, Tokyo; Hiroshi Yoshikawa, Tokyo; Hiroshi Okino, Tokyo, all of (JP)

(73) Assignee: Nissei Co., Ltd., Yamanashi-ken (JP)

( * ) Notice: Subject to any disclaimer, the term of this patent is extended or adjusted under 35 U.S.C. 154(b) by 0 days.

(21) Appl. No.: 09/895,313

(22) Filed: Jul. 2, 2001

Related U.S. Application Data

(63) Continuation of application No. 09/280,005, filed on Mar. 29, 1999, now abandoned.

(30) Foreign Application Priority Data

| | | |
|---|---|---|
| Apr. 2, 1998 | (JP) | 10-90288 |
| Apr. 2, 1998 | (JP) | 10-90301 |
| Apr. 2, 1998 | (JP) | 10-90305 |
| Apr. 2, 1998 | (JP) | 10-90308 |

(51) Int. Cl.[7] ..... B21H 5/02
(52) U.S. Cl. ..... 72/10.2; 72/14.4; 72/108
(58) Field of Search ..... 72/9.5, 10.2, 14.3, 72/14.4, 101, 104, 108; 29/893.32

(56) References Cited

U.S. PATENT DOCUMENTS

| | | | | |
|---|---|---|---|---|
| 4,167,106 A | * | 9/1979 | Berstein et al. | 72/108 |
| 5,339,669 A | | 8/1994 | Cretin et al. | |
| 5,799,398 A | | 9/1998 | Amateau et al. | |
| 5,918,495 A | | 7/1999 | Miyamoto et al. | |

FOREIGN PATENT DOCUMENTS

| | | |
|---|---|---|
| JP | 4-89151 | 3/1992 |

* cited by examiner

*Primary Examiner*—Lowell A. Larson
(74) *Attorney, Agent, or Firm*—Browdy and Neimark

(57) ABSTRACT

A round die type form rolling apparatus comprises: a pair of die moving blocks 15*a*, 15*b* rotatably supporting a pair of round dies 12*a*, 12*b*; four beam shafts 19 disposed around the rolling position of a work 33 being rolled by the round dies 12*a*, 12*b* and extending between the pair of die moving blocks 15*a*, 15*b*; and a push mechanism 20 for moving the pair of die moving blocks 15*a*, 15*b* toward each other. The die moving blocks 15*a*, 15*b* are moved, guided by the beam shafts 19, toward each other and the reaction forces generated between a pair of the round dies 12*a*, 12*b* by the rolling pressure are shared by the beam shafts 19 to prevent the round dies from escaping outwardly upwardly due to the reaction force from the work that is generated when the rolling pressure is applied to the work. This arrangement improves the machining precision of the work.

21 Claims, 11 Drawing Sheets

ROUND DIE TYPE FORM ROLLING APPARATUS

This is a continuation of copending parent application Ser. No. 09/280,005, filed Mar. 29, 1999, now abandoned.

BACKGROUND OF THE INVENTION

1. Field of the Invention

The present invention relates to a form rolling apparatus for manufacturing screws, gears, shafts, pipes and the like by rolling operations, and more specifically to a round die type form rolling apparatus which clamps a work between a pair of round dies and rolls the work in circumferential and axial directions by rotating the round dies.

2. Description of the Related Art

A conventionally known round die type form rolling apparatus of this kind is shown in FIG. 1 and FIG. 2. The round die type form rolling apparatus 1 rotates a pair of round dies 2*a*, 2*b* and pushes the rotating round dies symmetrically toward the center of a work 4 by hydraulic mechanisms 3*a*, 3*b* to apply a rolling pressure in the radial direction of the work 4 and thereby roll the work 4. On a base 5 are installed a pair of slide rails 6*a*, 6*b*, on which are laterally slidably mounted a pair of die moving blocks 7*a*, 7*b* that rotatably support a pair of round dies 2*a*, 2*b*. Fixedly mounted on the base 5 are a pair of pressure plates 8*a*, 8*b* to which the hydraulic mechanisms 3*a*, 3*b* are secured. Front ends of cylinder shafts 9*a*, 9*b* of the hydraulic mechanisms 3*a*, 3*b* are secured to the pair of the die moving blocks 7*a*, 7*b*, respectively. Between the round dies 2*a*, 2*b* is disposed a work support stand 10 that supports the work 4. During the rolling operation, the hydraulic mechanisms 3*a*, 3*b* are operated to drive a pair of the die moving blocks 7*a*, 7*b* toward each other, while rotating the round dies 2*a*, 2*b*, to form gears and screws.

In the conventional round die type form rolling apparatus 1 described above, however, when the hydraulic mechanisms 3*a*, 3*b* apply rolling pressures to the work 4, reaction forces P are produced between a pair of the round dies 2*a*, 2*b* as shown in FIG. 2. The reaction forces P are transmitted to the pressure plates 8*a*, 8*b*, causing the pressure plates 8*a*, 8*b* cantilevered on the base 5 to deflect and open upwardly as shown by two-dotted chain lines in the figure. When the pressure plates 8*a*, 8*b* are open, the cylinder shafts 9*a*, 9*b* are tilted, causing the die moving blocks 7*a*, 7*b* to pivot about their lower portions supported on the slide rails 6*a*, 6*b* and open upwardly as do the pressure plates 8*a*, 8*b*. Hence, the round dies 2*a*, 2*b* escape outwardly upwardly from the work 4. Therefore, the die moving blocks 7*a*, 7*b*, even when positioned correctly, move away from the work, making it impossible to form threads in the work 4 with high precision or, in the case of a gear, producing errors in a tooth shape of the work.

There is another drawback with the conventional round die type form rolling apparatus. When performing a so-called continuous rolling whereby an elongate work A longer than the widths of the round dies 2*a*, 2*b* is rolled, the conventional rolling process involves manually tilting main shafts 11*a*, 11*b* of the round dies 2*a*, 2*b*, fixing their tilt angles, with lead angles at contact portions between the round dies 2*a*, 2*b* and the work 4 kept aligned with each other, and moving the work 4 in the axial direction. With this method the tilt or inclination angle cannot be changed during the rolling operation, rendering versatile rolling operations on a work impossible.

When forming threads in the work 4, as the round dies 2*a*, 2*b* are progressively pressed against the work 4, the diameter of the root of a thread decreases. As a result, the circumferential length of the work. 4 at the root of the thread is shorter at the completion of threading or inscription than at the start of the threading. FIG. 3 shows the relation between the circumferential length of the work 4 and the pitch. The circumferential length of the work 4 decreases by δL from the circumferential length L at the start of the threading to the circumferential length L1 at the completion of the threading. With the conventional round die type form rolling apparatus 1, however, because the main shafts 11*a*, 11*b* cannot be inclined vertically during rolling operation, the lead angle β is kept constant even when the thread's root diameter of the work 4 changes. As a result, a deviation in pitch δP occurs between a pitch P of the work 4 at the start of the threading and a pitch P1 at the completion of the threading, with the result that the work 4 moves axially by a distance of the pitch deviation δP during the rolling operation. The phenomenon that the work 4 moves in the axial direction during the rolling operation is called a stepping or walking of the work 4 and this becomes most conspicuous when threads to be formed have a large difference between an external diameter and a root diameter. When the walking occurs, a flank of a screw thread on the same side as the direction of the walking-induced movement of the work 4 contacts the round dies 2*a*, 2*b* with an increased force, whereas a flank on the side opposite the direction of the walking-induced movement of the work 4 contacts the round dies 2*a*, 2*b* with a reduced force, giving rise to a problem of degraded finish precision of the rolled surfaces.

Further, when the work 4 is to be formed with serrations as shown in FIG. 4, the process involves bringing the main shafts 11*a* and 11*b* close to each other to slowly push the round dies 2*a*, 2*b* from positions indicated by two-dotted chain line in the figure toward the work 4. As a result, a root circle that connects roots 4*a* of the work 4 becomes small from a size indicated by two-dotted chain line in the figure to a size indicated by solid line. Because the modules of the round dies 2*a*, 2*b* are constant, as the root circle decreases in size, a large deviation occurs locally between a pitch formed in the work 4 at the start of inscription and a pitch formed in the work 4 at the completion of inscription. In the conventional round die type form rolling apparatus 1, because a pair of round dies 2*a*, 2*b* are rotated at the same speed by a combination of gears, this local pitch deviation cannot be absorbed, with the result that some tooth surfaces of the work 4 contact the dies with an increased force and other tooth surfaces with a reduced force. This in turn deteriorates the finish precision of the rolled tooth surfaces.

The conventional apparatus has still another problem. When the rolling operation is started, the round dies 2*a*, 2*b* are applied at the work contact surfaces with a force Fp, or a die load, in a direction normal to the dies and a force Ft in a tangential direction Ft. In the conventional round die type form rolling apparatus 1, because the main shafts 11*a*, 11*b* are controlled to rotate at a constant speed and move under a constant pressure or at a constant speed, both of the die load Fp and a rolling torque T acting on the main shafts 11*a*, 11*b* of the round dies 2*a*, 2*b* change between the start and completion of the rolling operation. The main shaft torque T, in particular, exhibits a temporary sharp increase or peak during the rolling operation. Because the peak of the main shaft torque T has a grave effect on the life of the round dies 2*a*, 2*b*, any increase in the peak value will lead to a reduced die longevity.

SUMMARY OF THE INVENTION

A first object of the present invention is to prevent the round dies from escaping outwardly upwardly due to the reaction force from the work when the work is applied with a rolling pressure.

A second object of the invention is to diversify the rolling operation on the work and to improve the finish precision of rolled surfaces by suppressing the walking of the work during the rolling operation.

A third object of the intention is to improve the finish precision of tooth surfaces when the work is formed with axial grooves such as serrations and splines.

A fourth object of the invention is to prevent a temporary increase in the machining torques acting on the main shafts of the round dies during the rolling operation to extend the longevity of the dies and improve the efficiency of the rolling operation.

To achieve the above objectives, a round die type form rolling apparatus according to the invention comprises: a set of die moving blocks rotatably supporting a set of round dies; two or more beam shafts disposed around a rolling position of a work being rolled by the round dies and extending between the set of die moving blocks; and a push mechanism for moving the set of die moving blocks toward each other; wherein the die moving blocks are moved, guided by the beam shafts, toward each other and reaction forces generated between the set of round dies by a rolling pressure are borne by the beam shafts.

A round die type form rolling apparatus according to another aspect of the invention comprises: a base; a first die moving block mounted on one end portion of the base; a pressure plate mounted on the other end portion of the base; two or more beam shafts disposed around a rolling position of a work and having both ends thereof mounted to the first die moving block and the pressure plate; a second die moving block disposed between the first die moving block and the pressure plate and guided by the beam shafts; a die push mechanism disposed between the second die moving block and the pressure plate; and a first round die and a second round die rotatably supported on the first die moving block and the second die moving block, respectively; wherein at least one of the first die moving block, the pressure plate and the second die moving block is rigidly fixed on the base, with the others slidably disposed, and the die push mechanism is operated to move the first die moving block and the second die moving block toward each other to roll the work between the first round die and the second round die.

A round die type form rolling apparatus according to still another aspect of the invention comprises: a base; a first die moving block mounted on one end portion of the base so that it is slidable to left and right; a pressure plate mounted on the other end portion of the base so that it is slidable to left and right; two or more beam shafts disposed around a rolling position of a work and having both ends thereof secured to the first die moving block and the pressure plate; a second die moving block disposed between the first die moving block and the pressure plate and guided by the beam shafts to slide on the base to left and right; a die push mechanism disposed between the second die moving block and the pressure plate; and a first round die and a second round die rotatably supported on the first die moving block and the second die moving block, respectively; wherein the die push mechanism is operated to slide the second die moving block guided by the beam shafts toward the rolling position, the pressure plate is slid the same distance in the opposite direction to cause the first die moving block through the beam shafts to slide the same distance toward the rolling position to roll the work between the first round die and the second round die that are disposed close to each other.

A round die type form rolling apparatus according to still another aspect of the invention is characterized in that three or four of the beam shafts are arranged in good balance around the rolling position of the work.

A round die type form rolling apparatus according to a further aspect of the invention is characterized in that a pinion is mounted on the base and that one of a pair of racks meshing with the pinion is secured to either the first die moving block or the pressure plate and the other of the pair of racks is secured to the second die moving block.

A round die type form rolling apparatus according to a further aspect of the invention is characterized by: distance detection means mounted between the set of the die moving blocks to measure a distance between the die moving blocks; and numerical control means to drive the die push mechanism based on a measured value of the distance detection means.

In a round die type form rolling apparatus which moves main shafts of rotating round dies toward a work to roll the work; the apparatus according to a further aspect of the invention is characterized by: main shaft inclination mechanisms for inclining the main shafts of the round dies in a plane perpendicular to a direction of movement of the main shafts; and a drive source for driving the main shaft inclination mechanisms.

A round die type form rolling apparatus according to a further aspect of the invention is characterized by: inclination angle detection means for detecting inclination angles of the main shafts; and control means for feeding back the inclination angles of the main shafts to control the inclination of the main shafts.

A round die type form rolling apparatus according to a further aspect of the invention is characterized in that the main shafts are inclined according to a change in a diameter of the work during the rolling operation and that a lead angle is corrected according to the change in the work diameter during the rolling operation to control the movement of the work.

A round die type form rolling apparatus according to a further aspect of the invention is characterized in that walking detection means is provided for detecting a walking of the work that occurs during the rolling of the work and that, based on a detection signal obtained by the walking detection means, the inclination angles of the main shafts are controlled to suppress the walking of the work or to hold the walking of the work constant.

In a round die type form rolling apparatus which clamps a work between a set of round dies and moves main shafts of the rotating round dies toward each other to roll the work; the round die type form rolling apparatus according to a further aspect of the invention is characterized by: servo motors for rotating the set of round dies and rotation angle detection means for detecting rotation angles of the set of round dies; and in that phases of the rotation angles of the set of round dies are changed relative to each other according to a change in a diameter of the work being rolled.

A round die type form rolling apparatus according to a further aspect of the invention is characterized in that the rotation angle detection means are directly connected to the main shafts of the round dies.

In a round die type form rolling apparatus which clamps a work between a set of round dies to roll the work; the round die type form rolling apparatus according to a further aspect of the invention is characterized by torque detection means for detecting rolling torques acting on the round dies and in that at least either revolution speeds of the round dies or moving speeds of the round dies are controlled to keep the rolling torques acting on the round dies during the rolling operation in a predetermined range.

A round die type form rolling apparatus according to a further aspect of the invention is characterized in that torque values detected by the torque detection means are compared with a set torque value and that a control is performed in such a way that when the detected torque values are higher than the set torque value, revolution speeds of the round dies are raised and that when the detected torque values are lower than the set torque value, the revolution speeds of the round dies are lowered.

A round die type form rolling apparatus according to a further aspect of the invention is characterized in that torque values detected by the torque detection means are compared with a set torque value and that a control is performed in such a way that when the detected torque values are higher than the set torque value, moving speeds of the round dies are lowered and that when the detected torque values are lower than the set torque value, the moving speeds of the round dies are raised.

With the construction described above, because the beam shafts are disposed around the rolling position of the work to be rolled by the round dies and extend between the left and right die moving blocks so as to bear the reaction forces generated between a set of the round dies by the rolling pressure, it is possible to prevent the die moving blocks from opening due to the reaction forces and the round dies from escaping outwardly upwardly as they would in the conventional apparatus. This in turn can improve the machining precision of the work.

Further, because at least one of the paired die moving blocks and the pressure plate is rigidly fixed on the base with the others slidably disposed, because the beam shafts are extended between one of the die moving blocks and the pressure plate, with the ends of the beam shafts secured to the die moving block and the pressure plate, and because the die moving blocks are moved toward each other by a single push mechanism, a simple construction using a single push mechanism can have the beam shafts bear the reactions generated between a set of the round dies.

Further, in the round die type form rolling apparatus according to the invention, a pair of the die moving blocks that are slidable to left and right and the pressure plate are mounted on the base; the beam shafts are extended between one of the die moving blocks and the pressure plate, with the ends of the beam shafts secured to the die moving block and the pressure plate; and a single push. mechanism is used to push one of the die moving block to cause both of the die moving blocks to slide simultaneously. In this construction, because the left and right die moving blocks and the pressure plate are not secured to the base, the reaction forces generated between the round dies can be shared more uniformly among the beam shafts.

Further, in the round die type form rolling apparatus according to the invention, because three or four of the beam shafts extending between a pair of the die moving blocks are disposed around the rolling position of the work in good balance, the reaction forces generated in the round dies by the rolling pressure can be shared equally among the three or four beam shafts.

Further, in the round die type form rolling apparatus according to the invention, because the pinion is mounted on the base and one of the paired racks meshing with the pinion is secured to either the first die moving block or the pressure plate and the other to the second die moving block, the center line of the work being rolled can be held stationary at all times, thus improving the machining precision of the work and facilitating the automation of supply and discharge of the work.

Further, because the round die type form rolling apparatus according to the invention includes the distance detection means mounted between a pair of the die moving blocks and the numerical control means for driving the push mechanism based on the measurement from the distance detection means, the depth of inscription formed by the round dies can be controlled with high precision.

Further, because the round die type form rolling apparatus according to the invention includes the main shaft inclination mechanisms for inclining the main shafts of the round dies in a plane perpendicular to the direction of movement of the main shafts and the drive source for the main shaft inclination mechanism, it is possible to suppress the walking of the work during the rolling operation and thereby improve the finish precision of the work and at the same time to diversify the mode of rolling by controlling the walking of the work.

Further, because the round die type form rolling apparatus according to the invention includes the inclination angle detection device for detecting the inclination angles of the main shafts and the control means for controlling the inclination of the main shafts by feeding back the inclination angles of the main shafts, the inclination angle of the main shafts can be controlled highly precisely, which in turn improves the rolling precision.

Further, in the round die type form rolling apparatus according to this invention, because the main shafts are inclined according to a change in the diameter of the work being rolled to correct the lead angle according to the change of the work diameter, the walking of the work caused by the work diameter change during the rolling operation can be prevented.

Further, in the round die type form rolling apparatus according to the invention, because the walking detection means for detecting the walking of the work is provided and because the main shafts are inclined according to a detected signal from the walking detection means to control the motion of the work, the walking of the work can be reliably prevented or held constant and the pitch kept constant, thereby improving the finish precision of the rolled surfaces.

Further, in the round die type form rolling apparatus according to the invention, the control is performed to change the rotation angles of a set of the round dies relative to each other as the diameter of the work being rolled changes, so that when the work is to be formed with axial grooves, a change in the circumferential length of the work can be distributed and absorbed among each of the pitches from the start of inscription toward the end of inscription, thereby producing smooth tooth surfaces of the work.

Further, in the round die type form rolling apparatus according to the invention, because the rotation angle detection means are directly connected to the main shafts of the round dies, the rotation angles of the round dies can be known precisely even when errors occur due to backlash and distortion in the die rotation transmission system.

Further, in the round die type form rolling apparatus according to the invention, because the machining torques acting on the round dies during the rolling operation are detected and at least one of the revolution speed and the moving speed of the round dies is controlled to bring the detected torques close to the preset torque value, it is possible to prevent the die torques from becoming large temporarily as observed in the conventional apparatus, thus extending the service life of the rolling dies and enhancing the efficiency of the rolling. Also by controlling the machining torques acting on the round dies, the depth of inscription in the work can be controlled with high precision, further improving the rolling precision.

Further, in the round die type form rolling apparatus according to the invention, the torque values detected by the torque detection means are compared with the set torque value, and when the detected torque values are higher than the set torque value, the revolution speeds of the round dies are raised and when the detected torque values are lower than the set torque value, the revolution speeds are lowered to control the detected torques to come close to the preset torque value. This makes it possible to keep the torque constant from the start of the rolling to the end and also keep the rolling time constant, which in turn makes the apparatus suitable for mass production of works.

Furthermore, in the round die type form rolling apparatus according to the invention, the torque values detected by the torque detection means are compared with the set torque value, and when the detected torque values are higher than the set torque value, the moving speeds of the round dies are lowered and when the detected torque values are lower than the set torque value, the moving speeds are raised to control the detected torques to come close to the preset torque value. This makes it possible to keep the torque constant from the start of the rolling to the end and also to know an ideal rolling time for each work.

These features and advantages of the present invention will be described in more detail by referring to the accompanying drawings

DESCRIPTION OF THE PREFERRED EMBODIMENT

Figure 1:
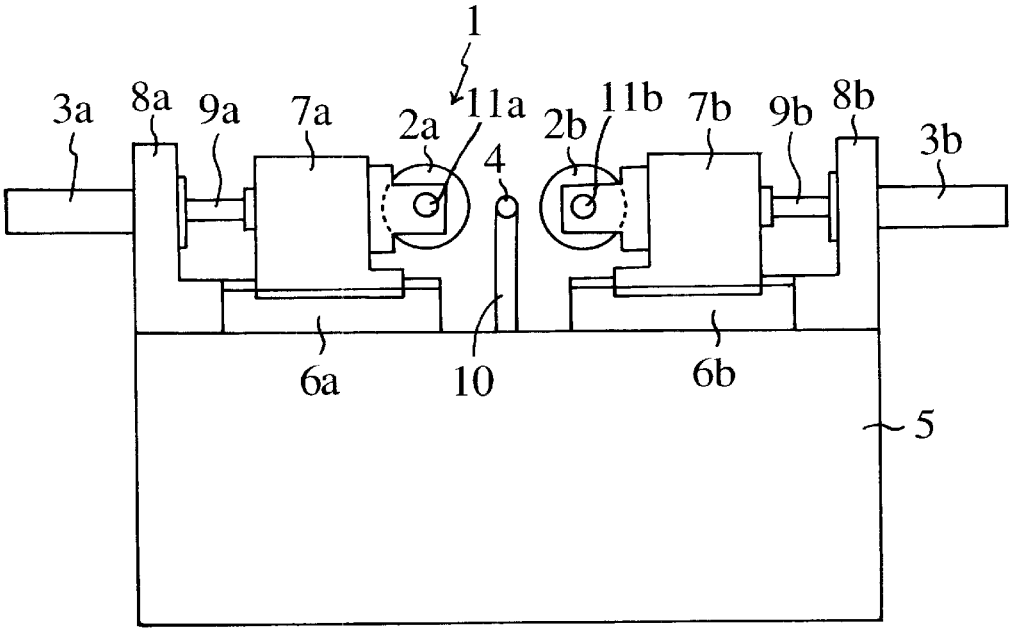
Fig. 1 (Prior Art)
FIG. 1 is a front view showing one example of a conventional round die type form rolling apparatus.
Figure 2:
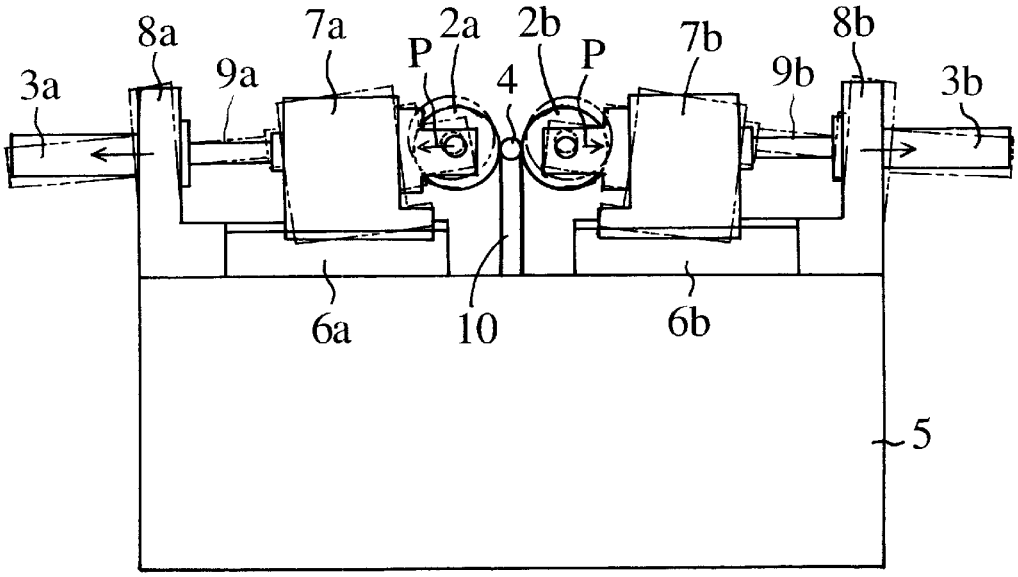
Fig. 2 (Prior Art)
FIG. 2 is a front view showing a state of the conventional round die type form rolling apparatus during a rolling operation.
Figure 3:
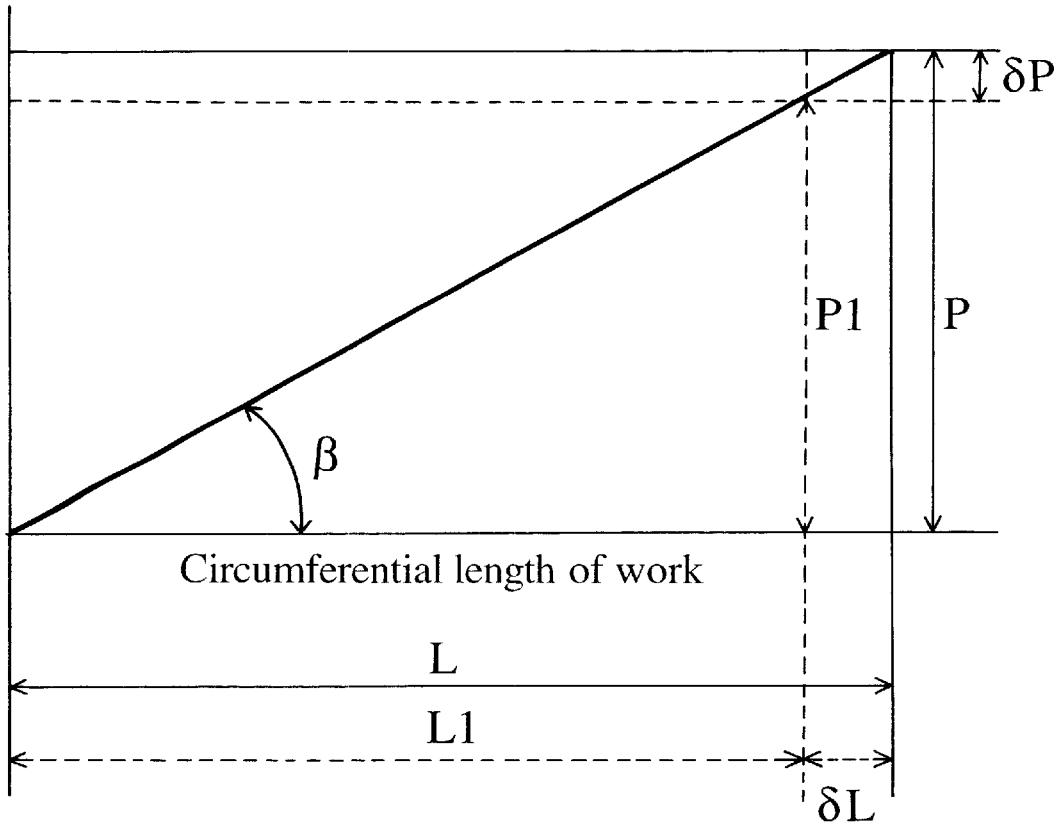
Fig. 3 (Prior Art)
FIG. 3 is a graph showing the relation between a circumferential length of a work and a pitch in the conventional round die type form rolling apparatus.
Figure 4:
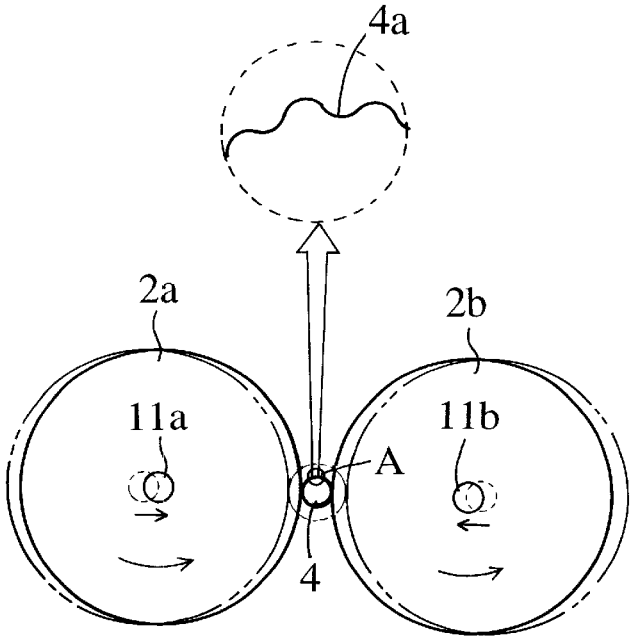
Fig. 4 (Prior Art)
FIG. 4 is a schematic view showing the relation between round dies of the conventional round die type form rolling apparatus and the work.
Figure 5:
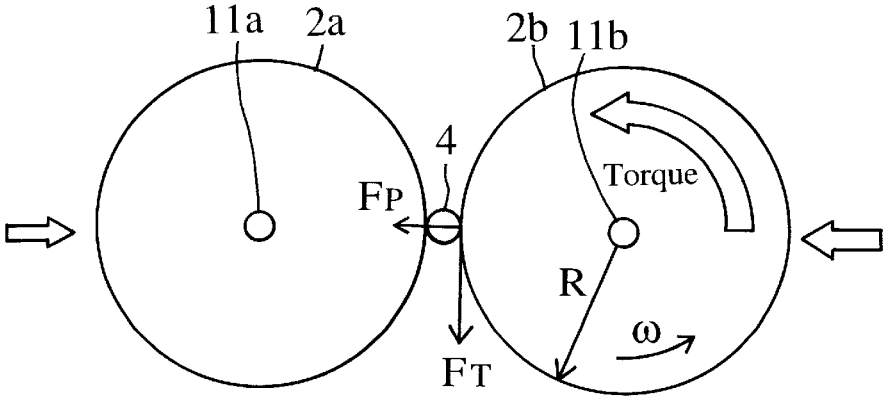
Fig. 5 (Prior Art)
FIG. 5 is a conceptual diagram showing how a rolling torque acts on the round dies of the conventional round die type form rolling apparatus.
Figure 6:
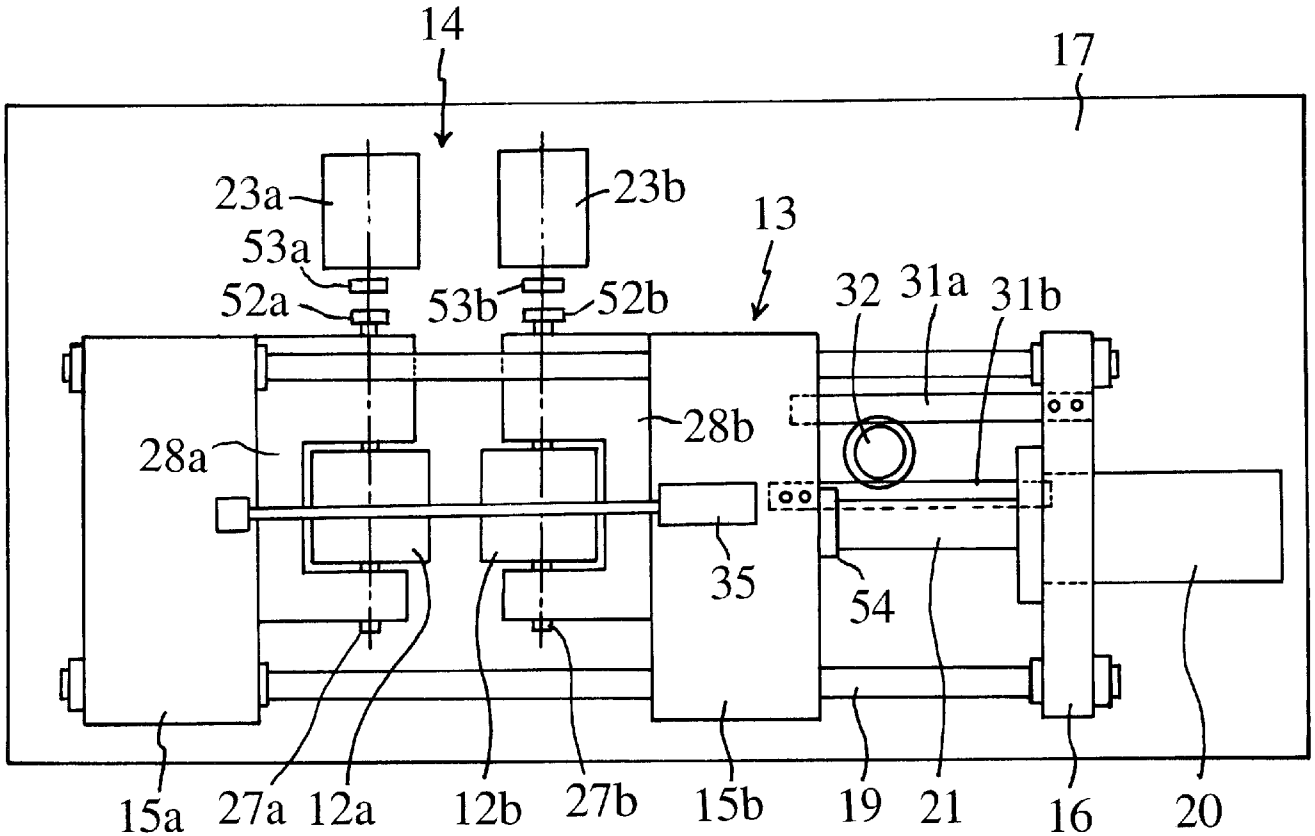
FIG. 6 is a plan view showing one embodiment of a round die type form rolling apparatus according to the invention.
Figure 7:
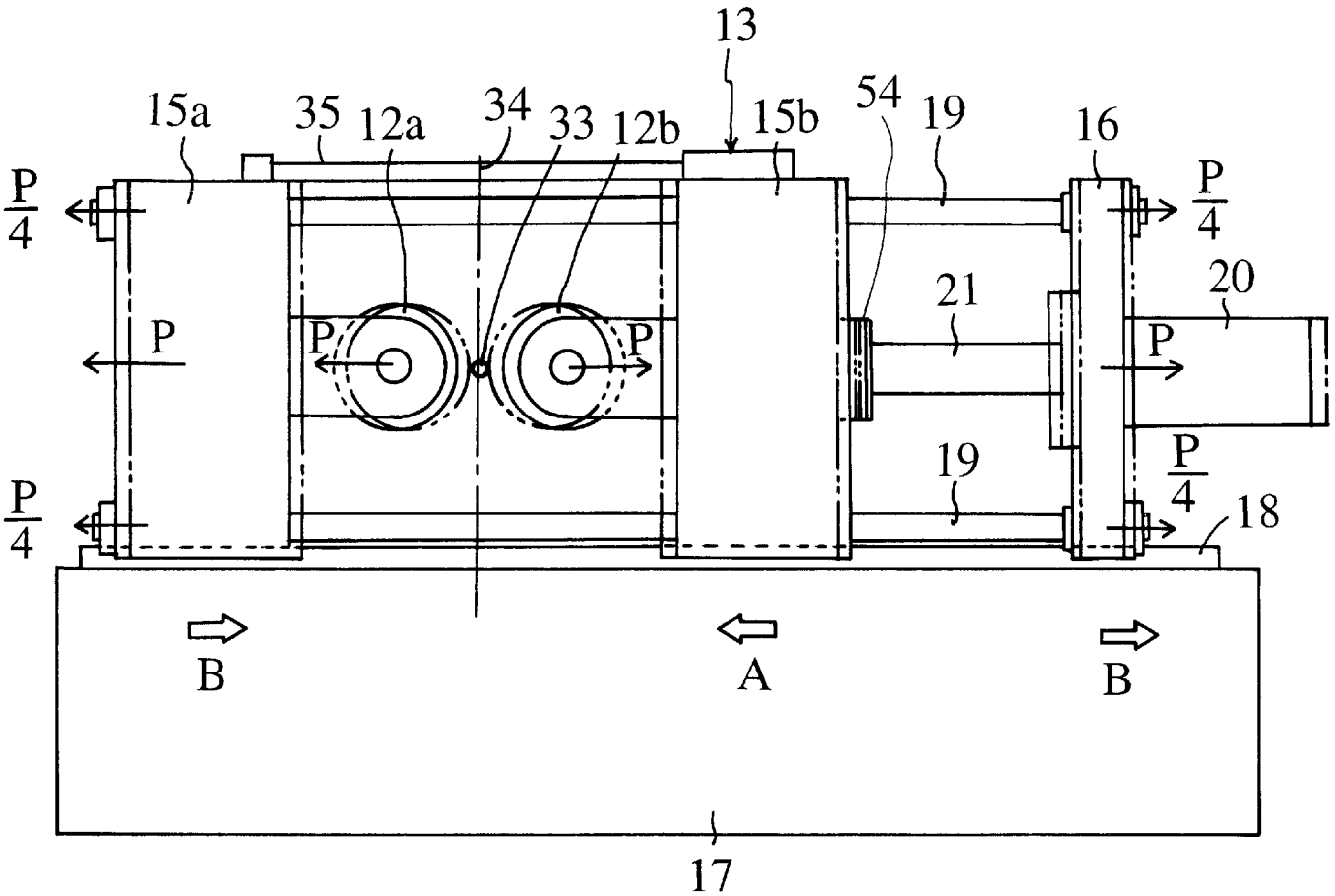
FIG. 7 is a front view of the embodiment of the round die type form rolling apparatus when it is operated.
Figure 8:
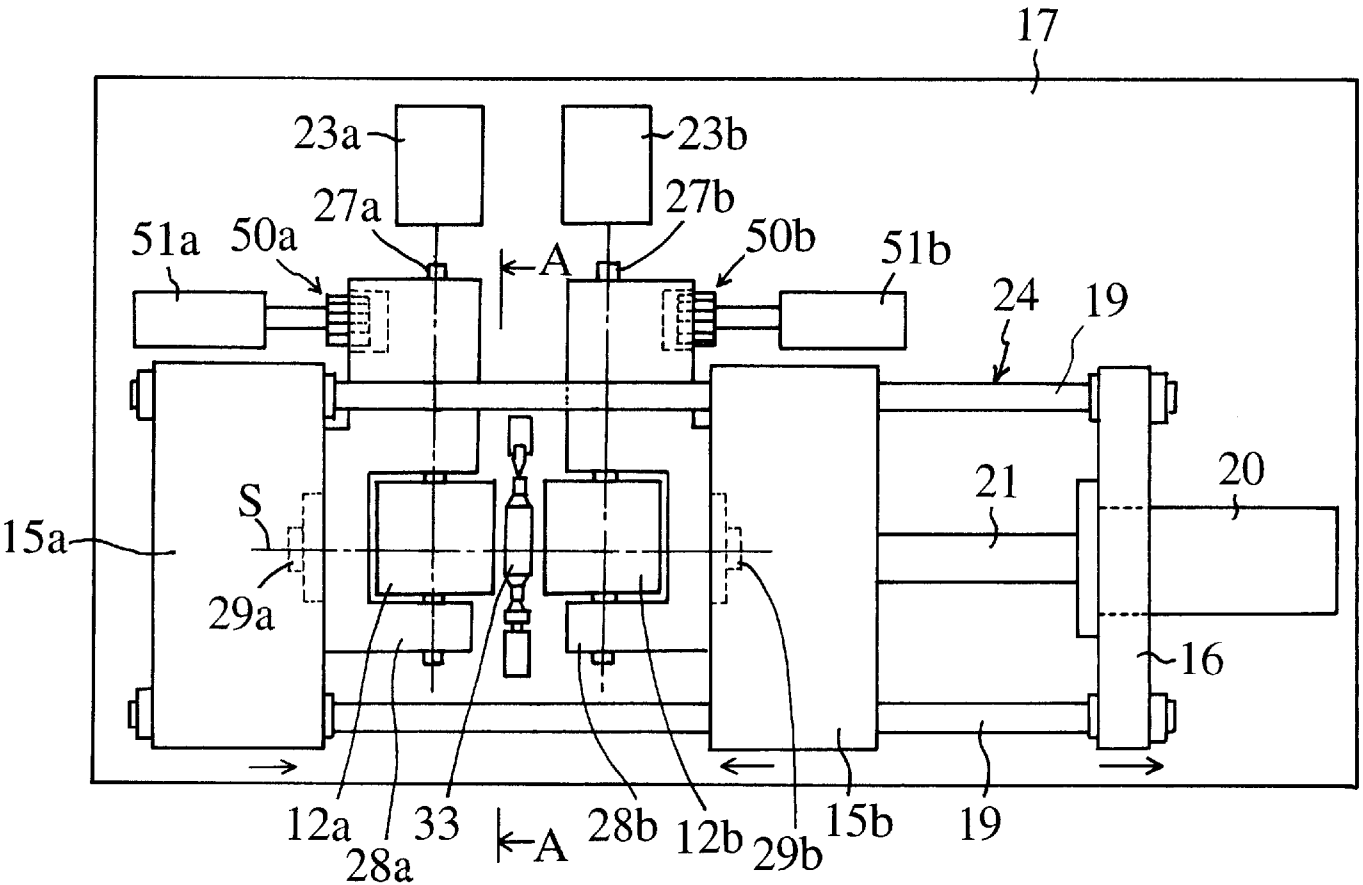
FIG. 8 is a plan view of a round die type form rolling apparatus according to the embodiment provided with main shaft inclination mechanisms.
Figure 9:
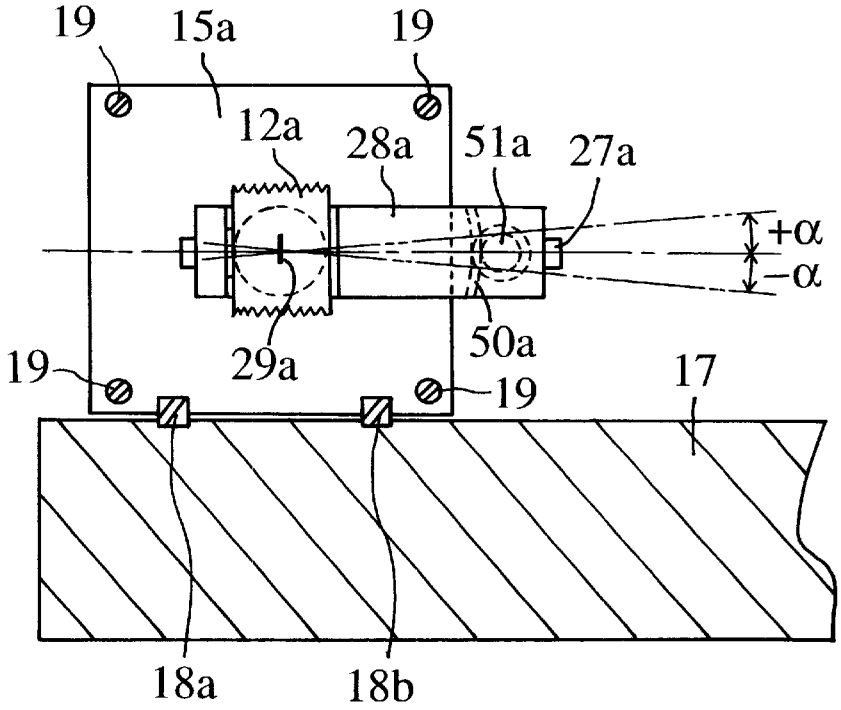
FIG. 9 is a cross section taken along the line A—A of FIG. 8 showing the main shaft inclination mechanisms in the embodiment of a round die type form rolling apparatus.
Figure 10:
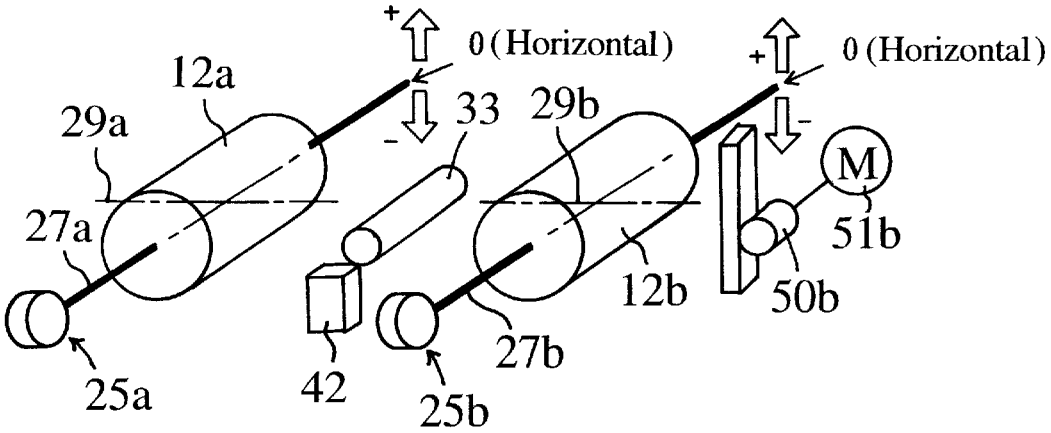
FIG. 10 is a conceptual diagram showing the main shaft inclination mechanisms in the embodiment of a round die type form rolling apparatus.
Figure 11:
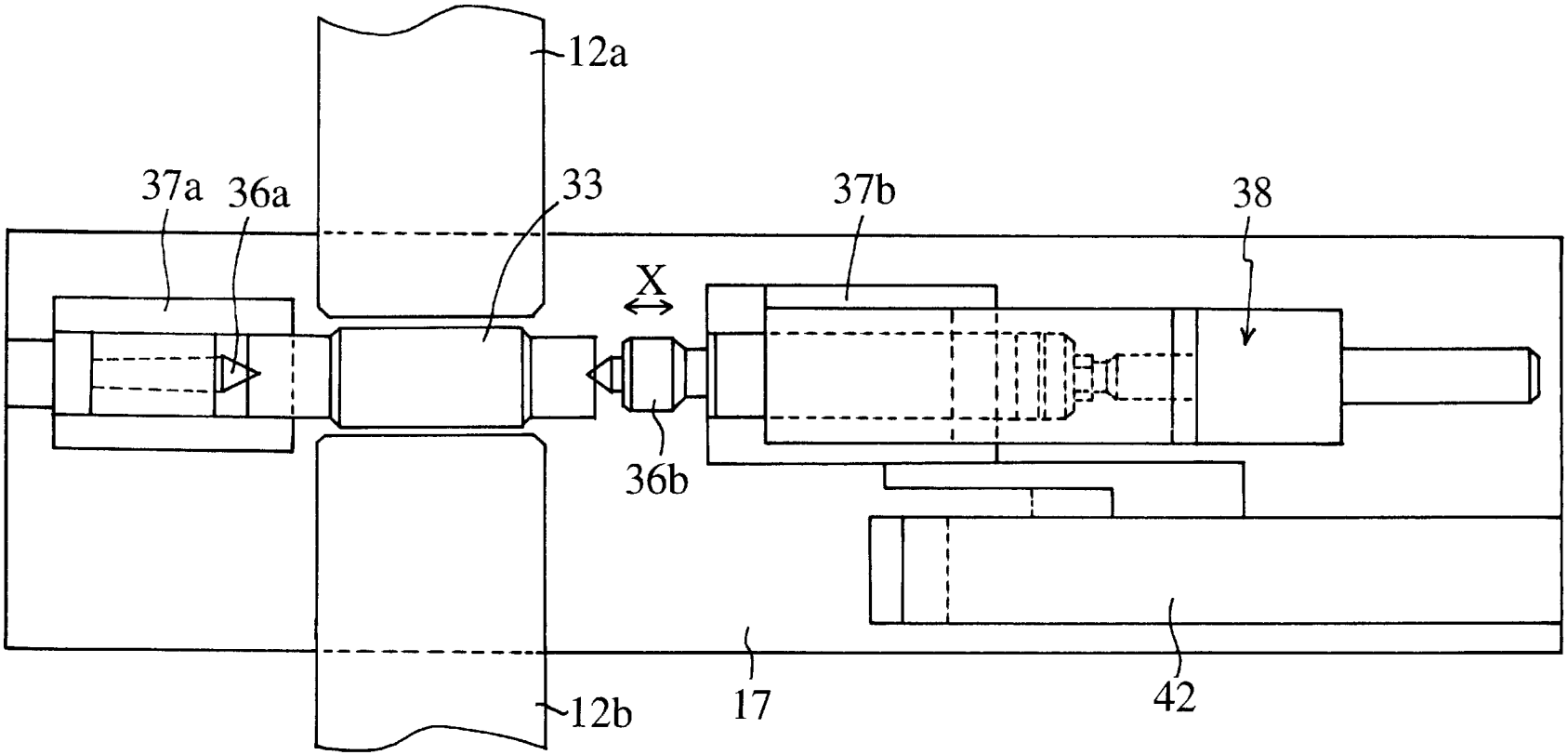
FIG. 11 is a plan view showing a clamp mechanism for a work in the embodiment of a round die type form rolling apparatus.
Figure 12:
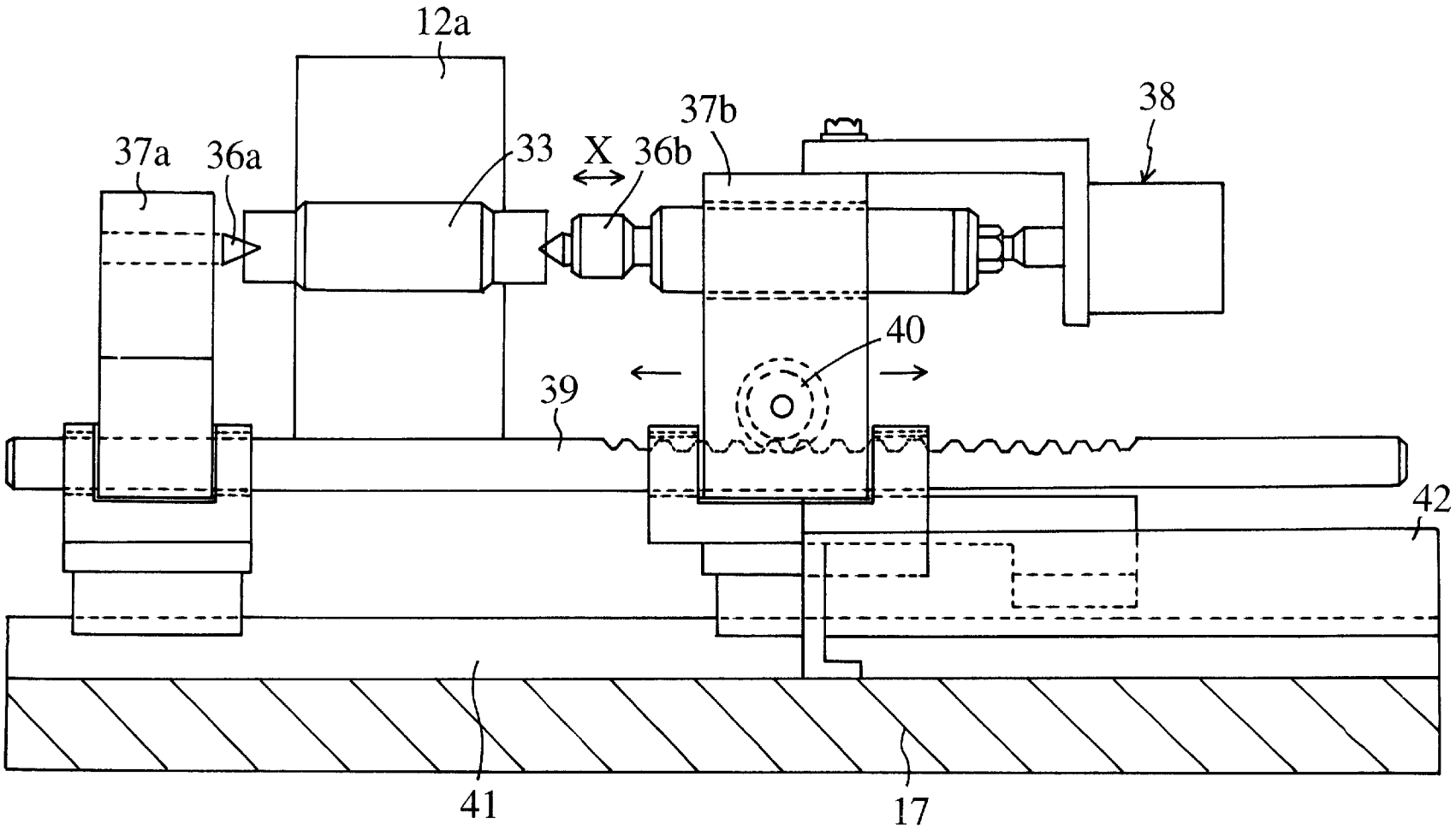
FIG. 12 is a side view showing the clamp mechanism for a work in the embodiment of a round die type form rolling apparatus.
Figure 13:
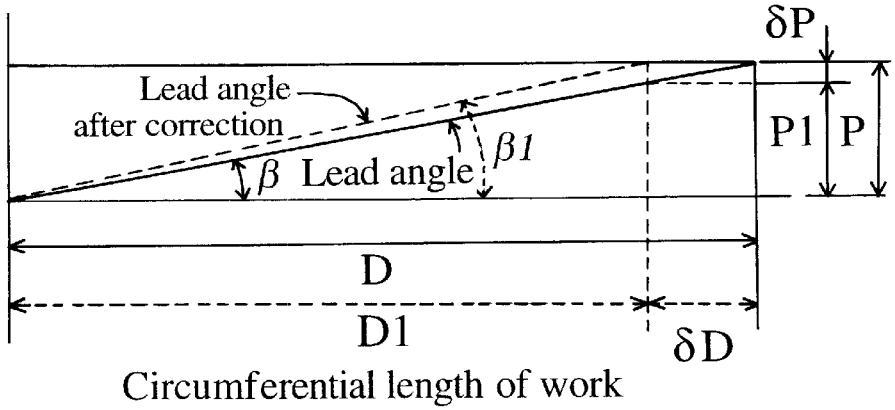
FIG. 13. is a graph showing the relation between a circumferential length of the work and a pitch when a round die type form rolling apparatus according to the embodiment is implemented.
Figure 15:
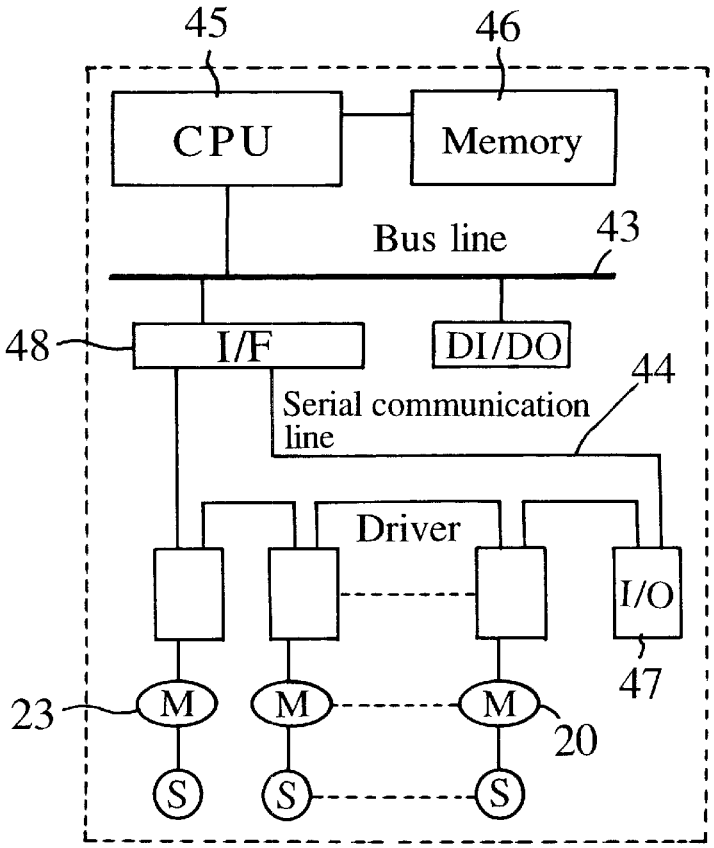
FIG. 15 is a configuration diagram of a control system for a round die type form rolling apparatus according to the embodiment.
Figure 14:
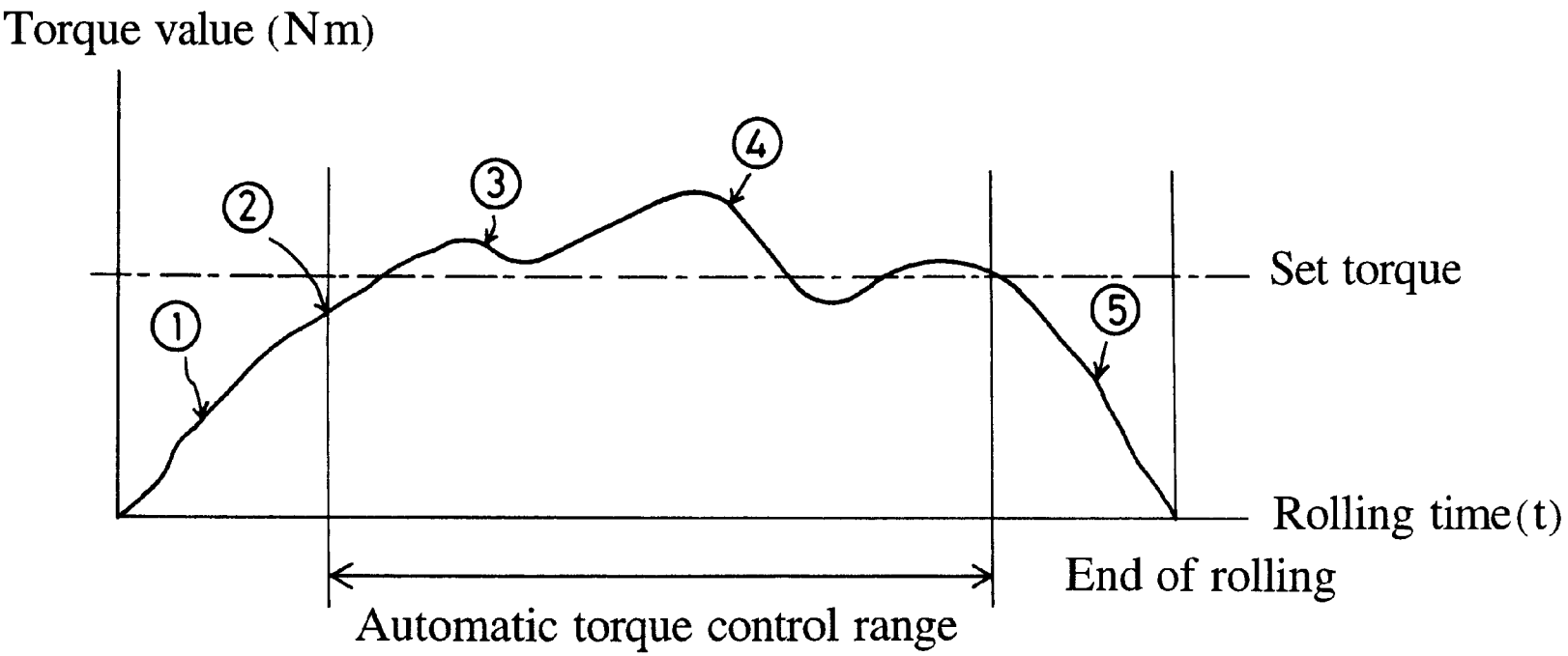
FIG. 14 shows a change in torque when a torque control method according to the invention is implemented.

One embodiment of a round die type form rolling apparatus according to the present invention will be described in detail by referring to the accompanying drawings. FIGS. 6 through 15 show one embodiment of the round die type form rolling apparatus according to the invention. Of these figures, FIG. 6 represents a plan view of the round die type form rolling apparatus according to the invention; and FIG. 7 represents a front view of the round die type form rolling apparatus of the embodiment when it is operated. FIG. 8 is an overall plan view of the round die type form rolling apparatus provided with main shaft inclination mechanisms; FIG. 9 is a cross section taken along the line A—A of FIG. 8; and FIG. 10 is a conceptual diagram of the main shaft inclination mechanisms. FIG. 11 is a plan view showing a clamp mechanism for a work in the round die type form rolling apparatus of the embodiment. FIG. 12 is a side view of the clamp mechanism. Further, FIG. 13 is a graph showing the relation between a circumferential length of the work and a pitch when the embodiment of the round die type form rolling apparatus is implemented. FIG. 14 is a graph showing the relation between a rolling time and a generated torque. FIG. 15 is a control system configuration for the round die type form rolling apparatus of the embodiment.

Referring now to FIGS. 6 and 7, the round die type form rolling apparatus rolls and forms a work 33 by clamping it between a pair of rotating round dies 12*a*, 12*b* and pressing them against the work 33. The apparatus has mounted on a base 17 a die moving block drive mechanism 13 for driving a pair of round dies 12*a*, 12*b* in a lateral direction, or in a radial direction of the work, to bring the round dies 12*a*, 12*b* close to each other, and a round die rotating mechanism 14 for rotating the round dies 12*a*, 12*b*.

The die moving block drive mechanism 13 includes a first die moving block 15*a*, a second die moving block 15*b* and a pressure plate 16, all arranged side by side on the base 17. The first die moving block 15*a* rotatably supports one round die 12*a* on an inner side surface of a die holder 28*a*. The second die moving block 15*b* rotatably supports another round die 12*b* on an inner side surface of a die holder 28*b*, which is opposite the die holder 28*a*. The pressure plate 16 is disposed outside the second die moving block 15*b*. These die moving blocks 15*a*, 15*b* and the pressure plate 16 are laterally slidably mounted on a pair of slide rails 18 fixedly mounted on the base 17. Further, four beam shafts 19 extend between the first die moving block 15*a* and the pressure plate 16 at four corners of inner opposing sides of the block and the plate. Both ends of the beam shafts 19 are secured to the first die moving block 15*a* and the pressure plate 16, respectively. Hence, the first die moving block 15*a* and the pressure plate 16 slide together on the slide rails 18 without changing their relative positions. The four beam shafts 19 have equal stiffness and are disposed at circumferentially quartered positions around, and equidistant from, a rolling center of the work 33 rolled by the round dies 12*a*, 12*b*. It is also possible to use three beam shafts 19 with equal stiffness and dispose them at circumferentially trisected positions equidistant from a rolling center of the work 33 rolled by the round dies 12*a*, 12*b*. With three or four beam shafts 19 disposed at well-balanced positions, when a pressure is applied between the first die moving block 15*a* and the pressure plate 16, the beam shafts 19 can be elongated in a stable condition while maintaining a parallel relationship between the first die moving block 15*a* and the pressure plate 16.

As long as the beam shafts 19 can be elongated while keeping the first die moving block 15*a* and the pressure plate 16 in a parallel relationship, the beam shafts 19 may have different stiffnesses or may be located at differing distances from the rolling center. While the above embodiment concerns a case where each of the die moving blocks 15*a*, 15*b* is provided with one round die 12*a*, 12*b*, they may each have two or more round dies 12*a*, 12*b* that can hold the work 33 between them.

The second die moving block 15*b* is slidably mounted on the slide rails 18 between the first die moving block 15*a* and the pressure plate 16 and has through-holes at four corners of side surfaces thereof through which to pass the four beam shafts 19 that guide the second die moving block 15*b*. The pressure plate 16 is fixedly provided with a push mechanism 20 such as hydraulic cylinder. The push mechanism 20 has a cylinder shaft 21 that extends or contracts in the same direction as the die moving block, and the front end of the cylinder shaft 21 is secured to an outer side surface of the second die moving block 15*b*. The push mechanism 20 is not limited to a hydraulic cylinder but may use a pneumatic device, a motor and a ball screw.

The round die rotating mechanism 14 rotates the first round die 12*a* and the second round die 12*b* at the same speed with high precision. The rotation control of the round dies is performed by transmitting rotating forces of servo motors 23*a*, 23*b* to main shafts 27*a*, 27*b* of the round dies 12*a*, 12*b*. Ends of the main shafts 27*a*, 27*b* projecting from the die holders 28*a*, 28*b* are mounted with rotary angle detection means 52*a*, 52*b*, such as rotary encoders, for controlling the revolution speeds of the round dies 12*a*, 12*b* in a closed loop.

Between the second die moving block 15*b* and the pressure plate 16 are installed a pair of racks 31*a*, 31*b* and a pinion 32, with the pinion 32 secured to the upper surface of the base 17. A pair of racks 31*a*, 31*b* each mesh with the pinion 32 from the front and back, with one rack 31*a* secured to a lower end of the pressure plate 16 and another rack 31*b* secured to a lower end of the second die moving block 15*b*. Although in this embodiment the pair of racks 31*a*, 31*b* and the pinion 32 are installed between the second die moving block 15*b* and the pressure plate 16, they may be disposed between the first die moving block 15*a* and the second die moving block 15*b*.

FIG. 7 shows the action of the first die moving block 15*a*, the second die moving block 15*b* and the pressure plate 16 when the die moving block drive mechanism 13 is operated. The condition after the cylinder shaft 21 is extended by activating the push mechanism 20 is shown by two-dotted chain line. When the cylinder shaft 21 is extended, the second die moving block 15*b* is pushed to slide on the slide rails 18 toward a center line 34 of the work 33 (in the direction of arrow A in the figure), In the mean time, because the racks 31*a*, 31*b* and the pinion 32 are installed between the second die moving block 15*b* and the pressure plate 16 as shown in FIG. 6, the pressure plate 16 is made to slide the same distance that the second die moving block 15*b* travels but in a direction opposite the direction in which the second die moving block 15*b* slides, i.e., toward the right in FIG. 7 (in the direction of arrow B). At this time, the first die moving block 15*a* connected to the pressure plate 16 by the four beam shafts 19 also moves the same distance in the same direction as the pressure plate 16 (in the direction of arrow B in the figure). Thus, the first die moving block 15*a* and the second die moving block 15*b* slide the same distances toward the center line 34 of the work 33, approaching each other. In this way, with the die moving block drive mechanism 13 according to the invention, the left and right die moving blocks 15*a*, 15*b* can be driven toward each other by the single push mechanism 20 to press the round dies 12*a*, 12*b* against the work 33 from both sides for rolling operation. The provision of the racks 31*a*, 31*b* and the pinion 32 enables the center line 34 of the work 33 to be held stationary, which in turn improves the machining precision of the work 33 and facilitates the automated supply and discharge of the work 33.

As the round dies 12*a*, 12*b* while being rotated are driven toward each other to press radially against the work 33 and apply a rolling pressure to it, the work 33 is rotated by the rolling pressure and repetitively undergoes localized plastic deformations, forming threads in the work 33. When the work 33 is applied with a rolling pressure, reaction forces P from the work 33 act on a pair of the round dies 12*a*, 12*b*, as shown in FIG. 7. The reaction force P acting on the first round die 12*a* is transmitted to the first die moving block 15*a*. The reaction force P acting on the second round die 12*b* is transmitted to the second die moving block 15*b*. Because the second die moving block 15*b* is secured to the cylinder shaft 21, the reaction force P transmitted to the second die moving block 15*b* is further transferred to the pressure plate 16 through the cylinder shaft 21.

That is, the reaction forces P produced by the rolling pressure ultimately act between the first die moving block 15*a* and the pressure plate 16. Because the first die moving block 15*a* and the pressure plate 16 are connected by the four beam shafts 19 and because the first die moving block 15*a* and the pressure plate 16 are not secured to the base 17, the reaction forces P are shared by the four beam shafts 19. Because the four beam shafts 19 are arranged at positions above and below the work 33 and have equal stiffness, the reaction forces P are divided into four equal portions and equally shared by the four beam shafts 19. In other words, the tensile force acting on each beam shaft is P/4. Although the four beam shafts 19 are axially elongated slightly by the reaction forces P, because they are elongated equally, the die moving blocks 15*a*, 15*b* can be prevented from opening and the round dies 12*a*, 12*b* from escaping outwardly upwardly as they would in the conventional apparatus. Further, because four beam shafts 19 are provided, the reaction forces generated in the round dies 12*a*, 12*b* can be stably shared equally among the four beam shafts 19.

Further, as shown in FIGS. 6 and 7, this embodiment has a linear scale 35 as distance detection means installed between a pair of the die moving blocks 15*a*, 15*b* so that the distance between the die moving blocks 15*a*, 15*b* can be directly measured. Because the die moving blocks 15*a*, 15*b* do not escape outwardly upwardly, the dimensional expansion that occurs between the round dies 12*a*, 12*b* during the rolling operation can be known precisely by measuring the distance between the die moving blocks 15*a*, 15*b* and the driving of the push mechanism 20 can be controlled based on the dimensional expansion. That is, because the round dies 12*a*, 12*b* open equally to the left and right when subjected to the reaction forces during the rolling operation, the distance between the main shafts 27*a*, 27*b*, i.e., the depth of inscription by the round dies 12*a*, 12*b*, can be controlled with high precision by measuring the distance between the die moving blocks 15*a*, 15*b* with the linear scale 35 during the rolling operation and feeding back a measured signal in a control loop to numerically control the driving of the push mechanism 20. The distance detection means may use a magnetostrictive sensor and a laser sensor rather than the linear scale 35.

In the round die type form rolling apparatus according to the embodiment, as shown in FIG. 8, the die holders 28*a*, 28*b* that rotatably support the main shafts 27*a*, 27*b* of the round dies 12*a*, 12*b* are pivotally mounted to the die moving blocks 15*a*, 15*b* so that the die holders 28*a*, 28*b* can be inclined in a plane (vertical plane) perpendicular to the direction of movement of the die moving blocks 15*a*, 15*b*. Pivotal centers 29*a*, 29*b* of the main shafts 27*a*, 27*b* are set so that the rolling position of the work 33 lies on a line S connecting the pivotal centers 29*a*, 29*b*.

The pivoting of the die holders 28*a*, 28*b* is performed by main shaft inclination mechanisms 50*a*, 50*b*. The main shaft inclination mechanisms 50*a*, 50*b* include die holder gears provided in the die holders 28*a*, 28*b* and motor gears that mesh with the die holder gears. Main shaft inclination servo motors 51*a*, 51*b* having the motor gears attached at the front ends thereof are arranged by the side of the die moving blocks 15*a*, 15*b*. The main shaft inclination mechanisms 50*a*, 50*b* may use link mechanisms rather than the gears, and the servo motors as a drive source may be replaced with hydraulic cylinders and pneumatic cylinders.

When the pivoting motion of the die holder 28*a* is to be controlled, the main shaft inclination servo motor 51*a* is operated to rotate the motor gear to transmit the rotating force to the die holder 28*a* through the die holder gear, as shown in FIG. 9. The die holder 28*a* then pivots about a pivotal center 29*a* by an amount corresponding to the rotation of the main shaft inclination servo motor 51*a*. Thus, the main shaft 27*a* parallel to the other main shaft can be inclined $+\alpha°$ upward (shown by a two-dotted chain line in the figure) and $-\alpha°$ downward (shown by a two-dotted chain line in the figure) in the vertical plane. The similar control is also performed on the other die holder 28*b*.

FIG. 10 shows control means for the main shaft inclination mechanisms 50*a*, 50*b*. Encoders 25*a*, 25*b* for measuring inclination angles of the main shafts 27*a*, 27*b* are attached to the ends of the main shafts 27*a*, 27*b*, and the inclination angles measured by the encoders 25*a*, 25*b* are fed back for numerical control of the number of revolutions of the main shaft inclination servo motors 51*a*, 51*b*. This makes it possible to precisely control the upward or downward inclination (in + or − direction in the figure) of the parallel main shafts 27*a*, 27*b* about the pivotal centers 29*a*, 29*b*. The encoders 25*a*, 25*b* may be incorporated into the main shaft inclination servo motors 51*a*, 51*b*. The control of the inclination angles of the main shafts 27*a*, 27*b* varies depending on various factors, such as the diameter and material of the work 33 to be rolled, the kind of thread to be formed, and the pitch.

FIGS. 11 and 12 show a clamp mechanism for the work 33. The work 33 is clamped axially between a support center 36*a* and a tail center 36*b*. The support center 36*a* is rigidly secured to one center stock 37*a* and the tail center 36*b* is slidably mounted to another center stock 37*b*. The center stock 37*b* has a pneumatic or hydraulic cylinder device 38 secured thereto, which drives the tail center 36*b* axially of the work 33 (in the direction of X in the figure). At the bottom of the center stocks 37*a*, 37*b* are provided a center stock adjustment rack 39 and a center stock adjustment pinion 40, both used to adjust a span between the center stocks 37*a*, 37*b*. The center stocks 37*a*, 37*b* are slidably mounted on a center stock slide rail 41 extending in the axial direction of the work 33. Provided by the side of the center stock 37*b* is walking detection means 42, such as a linear scale, that detects an axial movement of the center stock 37*b* axially clamping the work 33 to measure the amount of walking of the work 33.

FIG. 13 shows the relation between the lead angle, the circumferential length and the pitch of thread when the work 33 is thread-rolled by the round die type form rolling apparatus of the above construction. As shown in the figure, as the round dies 12*a*, 12*b* are progressively pressed against the work 33 and the threading proceeds, the root diameter of the thread of the work 33 decreases progressively. Hence, the circumferential length of the work 33 at the root of the thread decreases by $\delta D$ from D at the start of threading to D1 at the completion of threading. If the main shafts 27*a*, 27*b* are kept parallel, the lead angle $\beta$ of the work 33 does not change, which produces a pitch deviation $\delta P$ between the pitch P of the work 33 at the start of threading and the pitch P1 of the work 33 at the completion of threading. Hence, during the rolling operation the work 33 axially moves a distance equal to the pitch deviation $\delta P$. By progressively inclining a pair of the main shafts 27*a*, 27*b* in opposite directions during the rolling operation, however, the lead angle $\beta$ of the work 33 can be corrected according to a change in the circumferential length of the work during the rolling operation. Correcting the lead angle in this way can keep the pitch P of the work 33 constant and suppress the walking of the work 33. That is, the walking of the work 33 can be suppressed by slowly inclining the main shafts 27*a*, 27*b* to correct the lead angle $\beta$ of the work 33 as the diameter of the work 33 changes. At the end of the rolling operation, the lead angle $\beta$ of the work 33 becomes a corrected lead angle $\beta$1. Suppression of the walking of the work 33 in turn prevents a delamination of a flank of the thread which would occur in the conventional apparatus when the flank of the thread on the same side as the direction 6*f* movement of the work 33 engages the round dies 12*a*, 12*b* with a great force. It can also improve the finish precision of the worked surface. Further, it can prevent an insufficient rise or depth of the thread and a tapering of the thread due to rolling operation. In the case of a flanged work, the prevention of the walking allows the work to be rolled close to the flange. The change to the corrected lead angle $\beta$1 is sufficiently small that it falls well within the tolerance of the finished screw.

The inclination angles of the main shafts 27*a*, 27*b* are controlled by calculating in advance a lead angle value to which the lead angle should be corrected according to the diameter of the work 33 and the depth of inscription and using the calculated lead angle value as a target value for the servo mechanism. When the walking of the work 33 is detected by the walking detection means 42, both or one of the main shafts 27*a*, 27*b* are given a predetermined inclination angle and their inclination angles are controlled so that the reading of the walking detection means 42 remains constant.

In the round die type form rolling apparatus of the embodiment, because the inclination angles of the main shafts 27*a*, 27*b* can be controlled with high precision, it is also possible to make the work 33 move or walk, contrary to what was described above, by inclining the main shafts 27*a*, 27*b* at a predetermined angle. For example, fixing the dies shaped like abacus beads to the main shafts followed by inclining these main shafts can give the work an axial thrust force, and changing the distance between the main shafts enables the work to be rolled into desired shapes, thus permitting such machining as an external diameter drawing and an inner diameter working of solid and hollow materials and a forming of stepped shafts and pipes, all of which have only been achievable with swaging and ironing spinning. In addition, the setting of the shaft inclination angle for continuous rolling can be automated and, by controlling the distance between the main shafts, the shaft inclination angles and the die rotation angles with high precision, a wide range of machining becomes possible.

In the round die type form rolling apparatus of the embodiment, as shown in FIG. 6, the rotation angles of the main shafts 27*a*, 27*b* can be directly measured with the rotary angle detection means 52*a*, 52*b* such as rotary encoders directly attached to the ends of the main shafts 27*a*, 27*b*. The measurements of rotation angles are fed back to round die rotation control means (not shown) to control the rotation of the servo motors 23*a*, 23*b* for the main shafts. By controlling the rotation of the main shafts 27*a*, 27*b* in a full-closed loop, the rotation angles of the main shafts 27*a*, 27*b* can be numerically controlled to a target value with high precision even when errors are produced by gear backlash or torsion.

Next, the operation of rolling the work 33 by controlling the rotation angles of the main shafts 27*a*, 27*b* will be described. First, let us explain about a case where axial grooves such as splines and serrations are formed in the work 33 by rolling. A pair of round dies 12*a*, 12*b* are controlled in their rotation angles according to a change in the diameter of the work 33 during the rolling. That is, at the start of the rolling operation both of the round dies 12*a*, 12*b* rotate at the same speed in the same direction. As the groove in the work 33 deepens progressively during the course of rolling, however, a control is made to gradually change the rotation angle of a second round die 12*b* with respect to the rotation angle of a first round die 12*a*. For example, the circumferential length of the work 33 being rolled is divided by the number of teeth to be inscribed to determine a corrected pitch and then the rotation angle control is performed in such a way as to produce the corrected pitch. By controlling the rotation angle in this way, a change in pitch, which is produced when the groove diameter of the work 33 gradually changes from the start of inscription toward the completion of inscription, can be distributed and absorbed among a plurality of teeth. This prevents a large, local pitch deviation, providing smooth tooth surfaces of the work 33 and improving the finish precision. Such a control can also be applied for the rolling of gears with a large module. A rate of change of rotation angles of the main shafts 27*a*, 27*b* varies depending on various factors including the diameter and material of the work 33 to be rolled and the kind and pitch of the threads to be formed by rolling.

Next, a case will be explained in which a spiral thread is rolled on the outer circumference of the work 33 by controlling the rotation angles of the main shafts 27*a*, 27*b*. In a manner similar to that of the previous case, the rotation angles of a pair of the round dies 12*a*, 12*b* are controlled according to a change in the diameter of the work 33 being rolled. That is, at the start of rolling, both of the round dies 12*a*, 12*b* rotate at the same speed in the same direction. However, as the thread in the work 33 progressively deepens during the course of rolling, a control is performed to gradually change the rotation angle of a second round die 12*b* with respect to the rotation angle of a first round die 12*a*. This rotation angle control, as shown in FIG. 13, allows the lead angle of the work 33 to be gradually changed from β to a corrected lead angle β1 and therefore allows the pitch P to remain constant even when the circumferential length of the work 33 should change from D at the inception of inscription to D1 at the completion of inscription. Therefore, this control can eliminate a problem experienced with the conventional apparatus that the pitch may change during rolling operation causing the work 33 to walk in the axial direction, and thus can ensure a uniform contact between the flanks of the threads in the work 33 and the round dies 12*a*, 12*b*, resulting in an improved finish precision of the rolled surfaces.

Further, in the round die type form rolling apparatus of the embodiment, as show in FIG. 6, the main shafts 27*a*, 27*b* of the round dies 12*a*, 12*b* are each provided with torque detection means 53*a*, 53*b*, and the first die moving block 15*a* has load detection means 54 attached to the end thereof which measures the load of a die in the rolling process. The torque detection means 53*a*, 53*b* include, for example, a torque meter for directly measuring the torque value and means for detecting the load of a servo motor in the form of current or voltage and calculating a torque value from the detected value.

FIG. 14 shows a change in torque when a torque control method according to the invention is implemented. The abscissa represents a rolling time and the ordinate a torque value as detected by the torque detection means 53*a*, 53*b*. A chain-dotted line represents a set torque value. The set torque value is determined considering the detected values of die loads and die torques that are generated when the rolling operation is performed with the revolution speeds and the moving speeds of the main shafts 27*a*, 27*b* kept constant.

First, we will explain about a method of controlling the rolling torques within a predetermined range by controlling the revolution speeds of the main shafts 27*a*, 27*b*. Generally, as the revolution speeds of the main shafts 27*a*, 27*b* are increased, the number of rotations of the work 33 being rolled increases, thus reducing the depth of inscription and the torque produced. On the other hand, reducing the revolution speed reduces the number of rotations of the work 33, thus increasing the torque. The present invention takes advantage of this relation to control the generated torque at a predetermined value. The revolution speeds of the main shafts 27*a*, 27*b* are limited by upper and lower limits set by a limiter and are allowed to vary automatically in the range of the limiter. At point (1) in the figure immediately after the start of the rolling operation, the main shafts 27*a*, 27*b* rotate at a preset initial revolution speed. The torques produced gradually increase and come close to a set torque value, at which time ((2) in the figure) the torque control is started. The torque control involves, as a first step, comparing the torque values detected by the torque detection means 53*a*, 53*b* with the set torque value. When the detected torque values are lower than the set torque value, the main shafts 27*a*, 27*b* are given a rotation angle deceleration to lower the revolution speeds and thereby increase the torque values. When the torques further increase exceeding the set torque value (point (3) in the figure), the main shafts 27*a*, 27*b* are given a rotation angle acceleration to increase the revolution speeds and thereby lower the torque values. If, even with this control, the torques continue rising further (point (4) in the figure), the upper limit revolution speed of the limiter is set. As the rolling operation, while performing the torque control as described above, nears its end, the torques decrease and the torque control is terminated (point (5) in the figure). Then, the revolution speeds of the main shafts 27*a*, 27*b* are set with the lower limit value of the limiter. A plurality of rotation angle accelerations/decelerations with stepwise differing values may be set so that the rotation angle acceleration/deceleration progressively increases as the deviation of the generated torques from the set torque value increases. With this arrangement, when the detected torques deviate away from the set torque value, it is possible to quickly bring the generated torques close to the set torque value. When the generated torques come near the set torque value, this method can reduce a range of torque variations.

By controlling the machining torque produced during the rolling operation to come close to a preset torque value, the main shaft torque can be prevented from temporarily becoming excessively high during a peak, thus significantly extending the rolling die longevity compared with the conventional ones. Further, this torque control enables even a thin-walled hollow member to be rolled. The torque control method for the main shafts 27*a*, 27*b* described above can also be applied to a differential speed type rolling machine which pushes the work 33 by a feeder without moving the main shafts of the round dies 12*a*, 12*b*.

Next, an explanation will be given concerning a method of controlling the main shaft moving speeds so that the machining torques acting on the main shafts 27*a*, 27*b* will come close to a preset torque value. In this case, when the main shaft moving speeds are lowered, the number of rotations of the work 33 being rolled increases, reducing the depth of inscription and therefore the generated torque. On the other hand, increasing the main shaft moving speeds reduces the number of rotations of the work and increases the torque. The present invention utilizes this relation in performing the control to maintain the generated torque at a constant value. As in the case of the revolution speeds of the main shafts, the main shaft moving speeds are limited by upper and lower limits of a limiter and are allowed to vary automatically within the range of the limiter.

FIG. 15 shows an example configuration of a control system for the embodiment. The control system processes Programs and data stored in a memory 46 by a CPU 45 and sends the processed result to actuators such as servo motors 23*a*, 23*b* and push mechanism 20 via a communication control unit 48 connected a bus line 43. These actuators each have a driver circuit, and a plurality of these drivers and I/O ports 47 are connected to the communication control unit 48. The drivers, the I/O ports 47 and the communication control unit 48 are interconnected by a serial communication line 44.

Although the above embodiment has been shown to slide the left and right die moving blocks 15*a*, 15*b* together, it should be noted that the present invention can also be applied to a case where one of the die moving blocks 15*a*, 15*b* or the pressure plate 16 is rigidly fixed and the others are slidably movable. The round die type form rolling apparatus of the invention can also be applied to a case where the main shafts 27*a*, 27*b* are kept stationary and the work 33 is pushed between the round dies 12*a*, 12*b* and driven to rotate to be rolled. Further, a numerical control may be performed to rotate the main shafts 27*a*, 27*b* in opposite directions and move the work 33 upward or downward which is disposed perpendicular to the main shafts 27*a*, 27*b*, thus forming axial grooves in the work 33.

What is claimed is:

1. A round die type form rolling apparatus comprising:

a base;

a first die moving block for supporting a first round die, said first die moving block being slidably mounted on said base;

a second die moving block for supporting a second round die that is to be disposed opposite the first round die, said second die moving block being slidably mounted on said base to cause the second round die to move toward and away from the first round die;

a push mechanism for pushing said second die moving block;

a pressure plate mounted slidably on said base for supporting said push mechanism;

a plurality of beam shafts each having a first end fixed to said first die moving block and a second end fixed to said pressure plate; and motion transmitting means connected between said pressure plate and said second die moving block;

wherein said second die moving block is slidable along said beam shafts at a location between said first die moving block and said pressure plate;

and further wherein said push mechanism is operated to push said second die moving block over a distance in a first direction while said motion transmitting means cause said first die moving block and said pressure plate to move over the same distance in a second direction opposite to the first direction in response to the movement of said second die moving block in the first direction to cause the first and second round dies to move toward one another and to roll the work.

2. A round die type form rolling apparatus according to claim 1, wherein said motion transmitting means comprise a rack and pinion mechanism composed of a pinion mounted on the base and a pair of racks meshed with said pinion, and wherein one of the racks of said pair is secured to said pressure plate, and the other one of the racks of said pair is secured to said second die moving block.

3. A round die type form rolling apparatus according to claim 1, further comprising:

distance detection means mounted between the said first and second die moving blocks to measure a distance between said first and second die moving blocks; and numerical control means to drive said push mechanism based on a distance value measured by said distance detection means.

4. A round die type form rolling apparatus according to claim 1, further comprising:

main shaft inclination mechanisms for inclining the main shafts of the round dies in a plane perpendicular to a direction of movement of the main shafts; and a drive source for driving the main shaft inclination mechanisms; and inclination angle detection means for detecting inclination angles of the main shafts; and control means for feeding back the inclination angles of the main shafts to control the inclination of the main shafts;

walking detection means for detecting a walking of the work that occurs during the rolling of the work;

wherein based on a detection signal obtained by the walking detection means, the inclination angles of the main shafts are controlled to suppress or to hold constant the walking of the work.

5. A round die type form rolling apparatus according to claim 1, further comprising:

main shaft inclination mechanisms for inclining the main shafts of the round dies in a plane perpendicular to a direction of movement of the main shafts; and a drive source for driving the main shaft inclination mechanisms; and inclination angle detection means for detecting inclination angles of the main shafts; and control means for feeding back the inclination angles of the main shafts to control the inclination of the main shafts;

wherein the main shafts are inclined according to a change in a diameter of the work during the rolling operation, and a lead angle is corrected according to the change in the work diameter during the rolling operation to control the movement of the work.

6. A round die type form rolling apparatus according to claim 1, further comprising:

servo motors for rotating the set of round dies; and rotation angle detection means for detecting rotation angles of the set of round dies;

wherein phases of the rotation angles of the set of round dies are changed relative to each other according to a change in a diameter of the work being rolled.

7. A round die type form rolling apparatus according to claim 1, further comprising:

torque detection means for detecting rolling torques acting on the round dies;

wherein at least either revolution speeds of the round dies or moving speeds of the round dies are controlled to keep the rolling torques acting on the round dies during the rolling operation in a predetermined range.

8. A round die type form rolling apparatus according to claim 7, wherein torque values detected by the torque detection means are compared with a set torque value and a control is performed in such a way that when the detected torque values are higher than the set torque value, revolution speeds of the round dies are raised and that when the detected torque values are lower than the set torque value, the revolution speeds of the round dies are lowered.

9. A round die type form rolling apparatus according to claim 7, wherein torque values detected by the torque detection means are compared with a set torque value and a control is performed in such a way that when the detected torque values are higher than the set torque value, moving speeds of the round dies are lowered and that when the detected torque values are lower than the set torque value the moving speeds of the round dies are raised.

10. In a round die type form rolling apparatus in which main shafts of a set of round dies moves, in rotating condition, toward a work, clamp it therebetween and roll that work;

the round die type form rolling apparatus comprising:

main shaft inclination mechanisms for inclining the main shafts of the round dies in a plane perpendicular to a direction of movement of the main shafts; and a drive source for driving the main shaft inclination mechanisms; and inclination angle detection means for detecting inclination angles of the main shafts; and control means for feeding back the inclination angles of the main shafts to control the inclination of the main shafts;

walking detection means for detecting a walking of the work that occurs during the rolling of the work;

wherein based on a detection signal obtained by the walking detection means, the inclination angles of the main shafts are controlled to suppress or to hold constant the walking of the work.

11. In a round die type form rolling apparatus in which main shafts of a set of round dies moves, in rotating condition, toward a work, clamp it therebetween and roll that work;

the round die type form rolling apparatus comprising:

main shaft inclination mechanisms for inclining the main shafts of the round dies in a plane perpendicular to a direction of movement of the main shafts; and a drive source for driving the main shaft inclination mechanisms; and inclination angle detection means for detecting inclination angles of the main shafts; and control means for feeding back the inclination angles of the main shafts to control the inclination of the main shafts;

wherein the main shafts are inclined according to a change in a diameter of the work during the rolling operation, and a lead angle is corrected according to the change in the work diameter during the rolling operation to control the movement of the work.

12. In a round die type form rolling apparatus in which main shafts of a set of round dies moves, in rotating condition, toward a work, clamp it therebetween and roll that work;

the round die type form rolling apparatus comprising:

servo motors for rotating the set of round dies; and rotation angle detection means for detecting rotation angles of the set of round dies;

wherein phases of the rotation angles of the set of round dies are changed relative to each other according to a change in a diameter of the work being rolled.

13. In a round die type form rolling apparatus in which main shafts of a set of round dies moves, in rotating condition, toward a work, clamp it therebetween and roll that work;

the round die type form rolling apparatus comprising:

torque detection means for detecting rolling torques acting on the round dies;

wherein at least either revolution speeds of the round dies or moving speeds of the round dies are controlled to keep the rolling torques acting on the round dies during the rolling operation in a predetermined range.

14. A round die type form rolling apparatus according to claim 13, wherein torque values detected by the torque detection means are compared with a set torque value and a control is performed in such a way that when the detected torque values are higher than the set torque value, revolution speeds of the round dies are raised and that when the detected torque values are lower than the set torque value, the revolution speeds of the round dies are lowered.

15. A round die type form rolling apparatus according to claim 13, wherein torque values detected by the torque detection means are compared with a set torque value and a control is performed in such a way that when the detected torque values are higher than the set torque value, moving speeds of the round dies are lowered and that when the detected torque values are lower than the set torque value, the moving speeds of the round dies are raised.

16. In a round die type form rolling apparatus which includes:

a set of die moving blocks rotatably supporting a set of round dies;

three or more beam shafts disposed in a good balanced condition around a rolling position of a work being rolled by the round dies and extending between the set of die moving blocks;

a push mechanism for moving the set of die moving blocks toward each other;

main shaft inclination mechanisms for inclining the main shafts of the round dies in a plane perpendicular to a direction of movement of the main shafts;

a drive source for driving the main shaft inclination mechanisms;

inclination angle detection means for detecting inclination angles of the main shafts;

control means for feeding back the inclination angles of the main shafts to control the inclination of the main shafts; and walking detection means for detecting a walking of the work that occurs during the rolling of the work;

wherein the die moving blocks are moved, guided by the beam shafts, toward each other and reaction forces generated between the set of round dies by a rolling pressure are borne by the beam shafts; and based on a detection signal obtained by the walking detection means, the inclination angles of the main shafts are controlled to suppress or to hold constant the walking of the work.

17. In a round die type form rolling apparatus which includes:

a set of die moving blocks rotatably supporting a set of round dies;

three or more beam shafts disposed in a good balanced condition around a rolling position of a work being rolled by the round dies and extending between the set of die moving blocks;

a push mechanism for moving the set of die moving blocks toward each other;

main shaft inclination mechanisms for inclining the main shafts of the round dies in a plane perpendicular to a direction of movement of the main shafts;

a drive source for driving the main shaft inclination mechanisms;

inclination angle detection means for detecting inclination angles of the main shafts; and control means for feeding back the inclination angles of the main shafts to control the inclination of the main shafts;

wherein the die moving blocks are moved, guided by the beam shafts, toward each other and reaction forces generated between the set of round dies by a rolling pressure are borne by the beam shafts; and the main shafts are inclined according to a change in a diameter of the work during the rolling operation, and a lead angle is corrected according to the change in the work diameter during the rolling operation to control the movement of the work.

18. In a round die type form rolling apparatus which includes:

a set of die moving blocks rotatably supporting a set of round dies;

three or more beam shafts disposed in a good balanced condition around a rolling position of a work being rolled by the round dies and extending between the set of die moving blocks;

a push mechanism for moving the set of die moving blocks toward each other;

servo motors for rotating the set of round dies; and rotation angle detection means for detecting rotation angles of the set of round dies;

wherein the die moving blocks are moved, guided by the beam shafts, toward each other and reaction forces generated between the set of round dies by a rolling pressure are borne by the beam shafts; and phases of the rotation angles of the set of round dies are changed relative to each other according to a change in a diameter of the work being rolled.

19. In a round die type form rolling apparatus which includes:

a set of die moving blocks rotatably supporting a set of round dies;

three or more beam shafts disposed in a good balanced condition around a rolling position of a work being rolled by the round dies and extending between the set of die moving blocks;

a push mechanism for moving the set of die moving blocks toward each other; and torque detection means for detecting rolling torques acting on the round dies;

wherein the die moving blocks are moved, guided by the beam shafts, toward each other and reaction forces generated between the set of round dies by a rolling pressure are borne by the beam shafts; and at least either revolution speeds of the round dies or moving speeds of the round dies are controlled to keep the rolling torques acting on the round dies during the rolling operation in a predetermined range.

20. A round die type form rolling apparatus according to claim 19, wherein torque values detected by the torque detection means are compared with a set torque value and a control is performed in such a way that when the detected torque values are higher than the set torque value, revolution speeds of the round dies are raised and that when the detected torque values are lower than the set torque value, the revolution speeds of the dies are lowered.

21. A round die type form rolling apparatus according to claim 19, wherein torque values detected by the torque detection means are compared with a set torque value and a control is performed in such a way that when the detected torque values are higher than the set torque value, moving speeds of the round dies are lowered and that when the detected torque values are lower than the set torque value, the moving speeds of the round dies are raised.

* * * * *